US012702159B2

(12) United States Patent
Gasparyan et al.

(10) Patent No.: US 12,702,159 B2
(45) **Date of Patent: *Aug. 11, 2026**

(54) NON-COMBUSTIBLE AEROSOL DELIVERY SYSTEM FOR FILTERING EXHALATE

(71) Applicant: Nicoventures Trading Limited, London (GB)

(72) Inventors: Hripsime Gasparyan, London (GB); Simon James Copley, St. Ives (GB); Daniel Thomas Ahearn, London (GB); Matthew Maurice Homburg, St. Ives (GB)

(73) Assignee: Nicoventures Trading Limited, London (GB)

( * ) Notice: Subject to any disclaimer, the term of this patent is extended or adjusted under 35 U.S.C. 154(b) by 442 days.

This patent is subject to a terminal disclaimer.

(21) Appl. No.: 18/002,132

(22) PCT Filed: Jun. 16, 2021

(86) PCT No.: PCT/GB2021/051525

§ 371 (c)(1),
(2) Date: Dec. 16, 2022

(87) PCT Pub. No.: WO2021/255448

PCT Pub. Date: Dec. 23, 2021

(65) Prior Publication Data

US 2023/0217992 A1 Jul. 13, 2023

(30) Foreign Application Priority Data

Jun. 17, 2020 (GB) ..... 2009250

(51) Int. Cl.
*A24D 3/17* (2020.01)
*A24D 3/14* (2006.01)
(Continued)

(52) U.S. Cl.
CPC ..... *A24D 3/17* (2020.01); *A24D 3/14* (2013.01); *A24D 3/16* (2013.01); *A24F 40/40* (2020.01);
(Continued)

(58) Field of Classification Search
CPC ..... A24D 3/06; A24D 3/17; A24F 2700/04; A24F 13/00; A24F 40/30
(Continued)

(56) References Cited

U.S. PATENT DOCUMENTS 9,402,422 B2 8/2016 Shenkal
10,470,498 B2 11/2019 Shenkal et al.
(Continued)

FOREIGN PATENT DOCUMENTS

EP 3721726 A1 10/2020
WO 9423599 A1 10/1994
(Continued)

OTHER PUBLICATIONS

International Search Report and Written Opinion for International Application No. PCT/GB2021/051525, mailed on Oct. 6, 2021, 16 pages.
(Continued)

*Primary Examiner* — Michael H. Wilson
*Assistant Examiner* — Michael Patrick Mullen
(74) *Attorney, Agent, or Firm* — MERCHANT & GOULD P.C.

(57) ABSTRACT

There is provided a non-combustible aerosol delivery system for filtering exhaled breath, the aerosol delivery system including a power source; a filter unit; an inhalate airflow path adapted to convey vapor generated by the aerosol
(Continued)

delivery system to the user during an inhalation, and an exhalate airflow path adapted to convey breath from the user to the filter unit during an exhalation into the aerosol delivery system; wherein the filter unit contains at least one filter, and wherein the at least one filter comprises glass fiber, polypropylene, or combinations thereof.

13 Claims, 7 Drawing Sheets

(51) Int. Cl.

| | |
|---|---|
| ***A24D 3/16*** | (2006.01) |
| ***A24F 40/40*** | (2020.01) |
| ***A24F 40/42*** | (2020.01) |
| ***A24F 40/485*** | (2020.01) |
| *A24F 40/50* | (2020.01) |

(52) U.S. Cl.
CPC ..... *A24F 40/42* (2020.01); *A24F 40/485* (2020.01); *A24F 40/50* (2020.01)

(58) Field of Classification Search
USPC ..... 131/331
See application file for complete search history.

(56) References Cited

U.S. PATENT DOCUMENTS

| | | | | |
|---|---|---|---|---|
| 10,588,344 | B2 | 3/2020 | Shenkal et al. | |
| 10,617,148 | B2 | 4/2020 | Shenkal et al. | |
| 2016/0021929 | A1* | 1/2016 | Sawalha | A24F 1/30 131/329 |
| 2019/0247606 | A1 | 8/2019 | Williams | |
| 2020/0154760 | A1 | 5/2020 | Prog et al. | |
| 2020/0170295 | A1 | 6/2020 | Grimm et al. | |
| 2020/0305505 | A1 | 10/2020 | Shenkal et al. | |
| 2021/0127736 | A1 | 5/2021 | Grimm | |
| 2021/0227879 | A1* | 7/2021 | Ito | A24D 3/061 |

FOREIGN PATENT DOCUMENTS

| | | | | |
|---|---|---|---|---|
| WO | 9423600 | A1 | 10/1994 | |
| WO | WO-2020080529 | A1 * | 4/2020 | G01N 33/0004 |
| WO | 2020123286 | A1 | 6/2020 | |
| WO | 2020154701 | A1 | 7/2020 | |
| WO | 2021092086 | A1 | 5/2021 | |

OTHER PUBLICATIONS

"International Preliminary Report on Patentability received for PCT Patent Application No. PCT/GB2021/051525, mailed on Dec. 29, 2022", 9 pages.

* cited by examiner

NON-COMBUSTIBLE AEROSOL DELIVERY SYSTEM FOR FILTERING EXHALATE

PRIORITY CLAIM

The present application is a US National Phase of PCT/GB2021/051525, filed Jun. 16, 2021 and claims priority to Great Britain Application No. 2009250.8, filed Jun. 17, 2020, which applications are incorporated herein by reference.

BACKGROUND OF THE DISCLOSURE

Technical Field

The present disclosure relates to a non-combustible aerosol delivery system and a filter unit.

Description of the Prior Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present disclosure.

Non-combustible aerosol delivery system including systems such as electronic cigarettes (e-cigarettes) are known. Some such systems contain a reservoir of a source liquid containing a formulation, typically including an active material such as nicotine, from which an aerosol is generated, e.g. through vaporization. An aerosol source for an aerosol delivery device may thus comprise an aerosol generating component such as a heater having a heating element arranged to receive source liquid from the reservoir, for example through wicking/capillary action. Other source materials may be similarly heated to create an aerosol, such as botanical matter, or a gel comprising an active ingredient and/or flavoring. Hence more generally, the e-cigarette may be thought of as comprising or receiving a payload for heat vaporization. Other systems may provide aerosols from substances which may comprise one or more active constituents, one or more flavors, one or more aerosol-former materials, and/or one or more other functional materials.

While, or before, a user inhales on the device, electrical power is supplied to the heating element to vaporize a portion of aerosolizable material in the vicinity of the heating element, to generate an aerosol for inhalation by the user. Such devices are usually provided with one or more air inlet holes located away from a mouthpiece end of the system. When a user sucks on a mouthpiece connected to the mouthpiece end of the system, air is drawn in through the inlet holes and past the aerosol generating component. There is a flow path connecting between the aerosol generating component and an opening in the mouthpiece so that air drawn past the aerosol source continues along the flow path to the mouthpiece opening, carrying some of the aerosol generated by the aerosol generating component with it. The aerosol-carrying air exits the aerosol delivery device through the mouthpiece opening for inhalation by the user.

In conventional systems the smoking process concludes with this aerosol-delivery stage. As of 2019 there was an estimated 3.6 million e-cigarette users in Great Britain alone (7.1% of the population).

Improvements to this smoking process are disclosed herein.

SUMMARY OF THE INVENTION

In a first aspect of the disclosure there is provided non-combustible aerosol delivery system for filtering exhaled breath, the aerosol delivery system comprising:

- a power source;
- a filter unit;
- an inhalate airflow path, adapted to convey vapor generated by the aerosol delivery system to the user during an inhalation, and
- an exhalate airflow path, adapted to convey breath from the user to the filter unit during an exhalation into the aerosol delivery system;

wherein filter unit contains at least one filter, wherein the at least one filter comprises a material selected from glass fiber, polypropylene, and combinations thereof.

The system as disclosed herein allows for a user to inhale an aerosol and then exhale into the system. The exhalate can be processed by the system by the filter unit. The exhalate can advantageously be captured by the system disclosed herein. The filter unit may be arranged to remove aerosol droplets from the vapor. In particular, a filter formed from glass fiber, polypropylene and combinations thereof may be effective at capturing the exhalate. A balance is to be struck between the filtering (exhalate capture) provided by the filter used in the system and the pressure drop during exhalation experienced by a user. Proposed embodiments herein provide a balanced system for capturing exhalate while simultaneously providing a smooth inhale and exhale action for a user. As particles contact filter fibers they are collected and do not re-enter the vapor and are therefore effective filters.

Controlled removal of droplets from a vapor prevents said droplets condensing on components within the system. In this way, the controlled processing of a vapor reduces the likelihood of the vapor condensing and damaging components in the system. In this way, the lifetime of the system is prevented from being reduced by reducing wear from vapor condensing in the system in undesirable locations.

The filter unit may contain at least one filter comprising a material selected from glass fiber.

The filter unit may comprises at least a first filter comprising a material selected from glass fiber, and a second filter which is a HEPA filter.

The filter unit may contain at least one filter comprising a material selected from polypropylene.

The filter unit may comprise a separator for separating aerosol droplets from vapor. The separator is a preferred component for removal of aerosol droplets from a vapor as the removal is reasonable while the impact on pressure during exhalation for the user is also reasonable.

The aerosol delivery system may comprise an aerosol generating component, and wherein determining a change in the one or more operating parameters comprises determining a change in an operating parameter of the aerosol generating element.

The filter unit may comprise a vortex separator.

The filter unit may comprise a complex flow path separator.

The filter unit may comprise a water filtration unit, the water filtration unit comprising water through which exhalate may be passed to filter it. Advantageously, this improves the filtration of the exhalate. In turn, this reduces the work on other filter portions in the system and therefore increases the overall lifetime of the system.

The filter unit may comprise at least one deodorizing filter. Advantageously, the deodorizing filter allows for removal of undesirable odor from exhaled vapor. This can therefore improve the user's experience of the system. The at least one deodorizing filter may comprise at least one filter comprising activated carbon. Activated carbon is a particularly effective deodorizing filter.

In an example, at least a portion of the inhalate airflow path and a portion of the exhalate airflow path are the same. Advantageously, this enables the system to be more compact and therefore the system can be provided in a greater number of ergonomic conformations. This in turn improves the user's experience of the system.

In an example, the inhalate airflow path and the exhalate airflow path are entirely distinct from each other. In this way, the system prevents any exhalate being reinhaled on a subsequent puff. Each inhalation is a new inhalation and does therefore not suffer from inclusion of unintended material. In turn, this improves the user's experience of the system.

In an example, the non-combustible aerosol delivery system further comprises a unit containing a vapor forming material. The unit may be more easily removed from and returned to the system than vapor forming material alone. The user interacts with the unit rather than the vapor forming material which is a simpler and cleaner process. In turn, this therefore improves the user's experience of the system.

In an example, the filter unit and the unit containing the vapor forming material together form a single assembly which is removable from the non-combustible aerosol delivery system. Removal of the single assembly enables the system (both parts) to be more readily accessed. In turn, this leads to an increased ease of cleaning and repair of system. Regular cleaning decreases potential damage to the system done by condensed matter within the system and therefore increases the lifetime of the system.

In an example, the non-combustible aerosol delivery system is an electronic cigarette.

In an example, the non-combustible aerosol delivery system is an aerosol generating material heating system.

In an example, the non-combustible aerosol delivery system generates aerosol using a combination of aerosol-generating materials, one or a plurality of which may be heated. Use of a plurality of aerosol-generating materials enables the system to provide a flexible and measured aerosol to the user. Greater control over the options available allows a user to control the aerosol produced to that of a bespoke aerosol tailored to the user's preferences. In this way, the user experience of the system is improved.

In a further aspect, there is provided a filter unit configured to engage with a non-combustible aerosol delivery system, wherein the filter unit contains at least one filter, wherein the at least one filter comprises a material selected from glass fiber, polypropylene, and combinations thereof, and wherein the non-combustible aerosol delivery system is for filtering exhaled breath and comprises:

a power source;

a filter unit;

an inhalate airflow path, adapted to convey vapor generated by the aerosol delivery system to the user during an inhalation, and an exhalate airflow path, adapted to convey breath from the user to the filter unit during an exhalation into the aerosol delivery system.

Further aspects are provided in accordance with the claims.

It is to be understood that both the foregoing general summary of the disclosure and the following detailed description are exemplary, but are not restrictive, of the disclosure.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DESCRIPTION OF THE EMBODIMENTS

Figure 1:
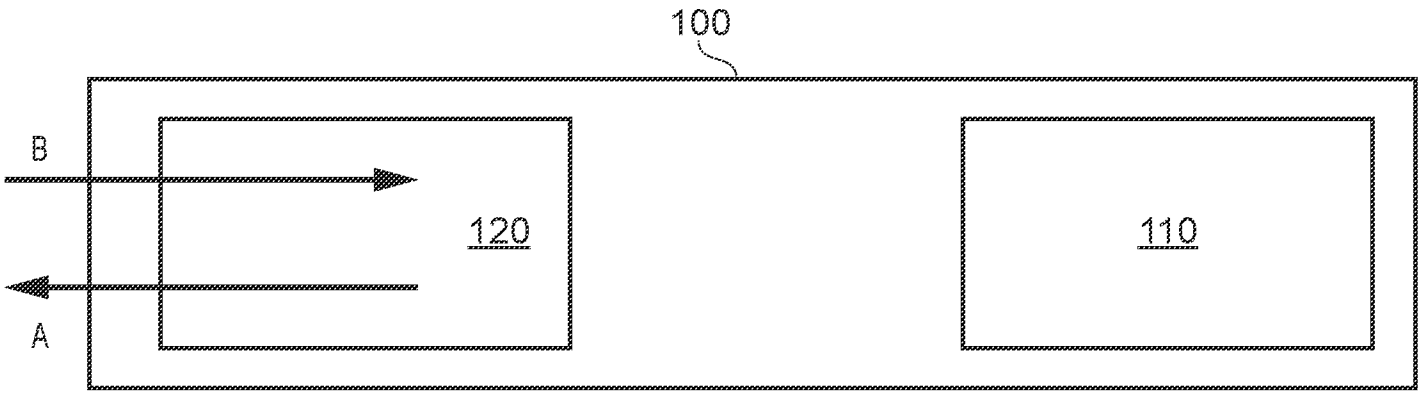
FIG. 1 schematically shows a longitudinal cross-sectional view of an example of a non-combustible aerosol delivery system.

A non-combustible aerosol delivery system and filter unit are disclosed. In the following description, a number of specific details are presented in order to provide a thorough understanding of the embodiments of the present disclosure. It will be apparent, however, to a person skilled in the art that these specific details need not be employed to practice embodiments of the present disclosure. Conversely, specific details known to the person skilled in the art are omitted for the purposes of clarity where appropriate.

As described above, the present disclosure relates to a non-combustible aerosol delivery which may include an electronic aerosol delivery system or a vapor delivery device such as an e-cigarette or nebulizer. Throughout the following description the term "e-cigarette" is sometimes used but this term may be used interchangeably with (electronic) aerosol/vapor delivery system. Similarly the terms 'vapor' and 'aerosol' are referred to equivalently herein.

Generally, the non-combustible aerosol delivery device may be an electronic cigarette, also known as a vaping device or electronic nicotine delivery system, although it is noted that the presence of nicotine in the aerosolizable material is not a requirement. In some embodiments, a non-combustible aerosol delivery device is a tobacco heating system, also known as a heat-not-burn system. In some embodiments, the non-combustible aerosol delivery device is a hybrid system to generate aerosol using a combination of aerosolizable materials, one or a plurality of which may be heated. Each of the aerosolizable materials may be, for example, in the form of a solid, liquid or gel and may or may not contain nicotine. In some embodiments, the hybrid system comprises a liquid or gel aerosolizable material and a solid aerosolizable material. The solid aerosolizable material may comprise, for example, a tobacco or a non-tobacco product. Meanwhile in some embodiments, the non-combustible aerosol delivery device generates a vapor or aerosol from one or more such aerosolizable materials.

Typically, the aerosol delivery system may comprise a non-combustible aerosol delivery device and an article for use with the non-combustible aerosol delivery device. However, it is envisaged that articles which themselves comprise a means for powering an aerosol generating component may themselves form the non-combustible aerosol delivery device.

In some embodiments, the aerosolizable material may comprise an active material, an aerosol forming material and optionally one or more functional materials. The active material may comprise nicotine (optionally contained in tobacco or a tobacco derivative) or one or more other non-olfactory physiologically active materials. A non-olfactory physiologically active material is a material which is included in the aerosolizable material in order to achieve a physiological response other than olfactory perception. The aerosol forming material may comprise one or more of glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate. The one or more functional materials may comprise one or more of flavors, carriers, pH regulators, stabilizers, and/or antioxidants.

Referring now to the drawings, wherein like reference numerals designate identical or corresponding parts throughout the several views, FIG. 1 is a schematic diagram of non-combustible aerosol delivery system 100 for filtering exhaled breath in accordance with some embodiments of the disclosure (not to scale). The non-combustible aerosol delivery system 100 comprises a power source 110 and a filter unit 120. The system 100 has an inhalate airflow path illustrated by arrow A. The inhalate air flow path A is adapted to convey vapor (or aerosol) generated by the aerosol delivery system 100 to a user during an inhalation of the user. The system 100 has an exhalate airflow path illustrated by arrow B. The exhalate airflow path B is adapted to convey breath from the user to the filter unit 120 during an exhalation into the aerosol delivery system 100. The filter unit 120 contains at least one filter. The at least one filter comprises a material selected from glass fiber, polyprolylene, and combinations thereof.

The system 100 is arranged to pass breath from the user through the filter unit 120. The filter unit 120 is arranged to collect the vapor passing through the system 100 in the breath exhaled by a user. In this way, the user may optionally exhale through the system 100 when desiring to not exhale vapor. This may be particularly advantageous in areas of close proximity to others or in areas where vapor production is not allowed or discouraged.

The user therefore is able to use the system 100 as a way to capture exhalate and not produce a visible exhalation.

The filter unit 120 therefore is arranged to effectively collect vapor from the breath of a user. This may be by use of a filter in the filter unit 120 comprising a material selected from glass fiber. In other examples, the filter unit 120 may have additionally or alternatively a filter which is a high-efficiency particulate air (HEPA) filter. The HEPA filter may be formed from non-woven glass filament sheets of fabric, cellulosic 'paper' sheets or plastic fibers. These may be formed into a high surface area filter through corrugation and the use of a tortuous path. HEPA filters may be made of either micro glass fibers, or polymers, or a mixture of both (a combination can be used to make filters stronger when pleating). Polymers are seen to have a small benefit in electrostatic attraction of particles.

In other examples, the filter unit 120 may have additionally or alternatively a filter which comprises a material selected from polypropylene.

Each of these filters have shown to be particularly advantageous at retaining vapor. Tests have been conducted to detect the efficacy of filters in light of age (number of puffs), pressure and the like.

The system 100 therefore is able to remove vapor from the breath of a user which is exhaled through exhalate flow path B. Furthermore, the system 100 is able to remove vapor from the exhalate by, for example, use of a separator for separating aerosol droplets from vapor. In a specific example, the filter unit 120 comprises a vortex separator for removing aerosol droplets from vapor. This advantageously combines with the materials for the filter in the filter unit 120 to more efficiently remove vapor from the exhalate flow.

In an example, the system 100 can further comprise a complex flow path separator. The complex flow separator may be part of the filter unit 120 or separate from the filter unit 120. The complex flow path separator may divert or redirect exhalate flow in the system 100. In an example, the complex flow path separator elongates the path along which the exhalate flow travels which enables more separation of the aerosol droplets from the vapor. In turn, this enables a more efficient system 100 for receiving and processing an exhalate flow. Reducing pressure drop across the system 100 during the exhalation of a user is advantageous as the user experience a lesser flow restriction. In this way, as the above elements perform the function of the system 100 while reducing the pressure drop, the user experience is improved.

In an example, the filter unit 120 further comprises a water filtration unit. The water filtration unit may comprise water through which exhalate may be passed to filter it. Water filtration works by passing bubbles of vapor through a liquid to impact them, in this case water. This technique is particularly effective as vapor bubbles has a large water-vapor surface area for interaction, but other liquids may be used. This technique may be used alongside others to collect vapor from the exhalate breath of a user.

In an example, the filter unit 120 may comprise at least one deodorizing filter.

In an example, the filter unit 120 may comprise at least one deodorizing filter comprising activated carbon. Activated carbon allows absorption of volatile compounds which may be present in the exhalate. Removing and absorbing these is of particular advantage to prevent the volatile compounds impacting other components of the system 100. A further advantage relates to the pressure drop experienced with activated carbon, which is similar to types of aerosolizable material that may be used with the present system 100 to generate an aerosol for inhalation by a user. Therefore, the user may experience little or no pressure drop during the exhalation breath. Therefore, in turn, this further improves the user's experience of the system 100. Activated carbon may be provided in a block or the like which a number of bores through the block for allowing the passage of exhalate.

In an example, a portion of the inhalate airflow path and a portion of the exhalate airflow path are the same. Utilizing the same path for a portion of the inhalate and exhalate airflow paths allows the option of using one outlet in the system 100. In this way, the reduction of number of components in the system 100 increases the overall lifetime of the system 100. Similarly, a shared portion allows for more compact conformations of the system 100, which can lead to an improved user experience with the system 100.

Figure 2:
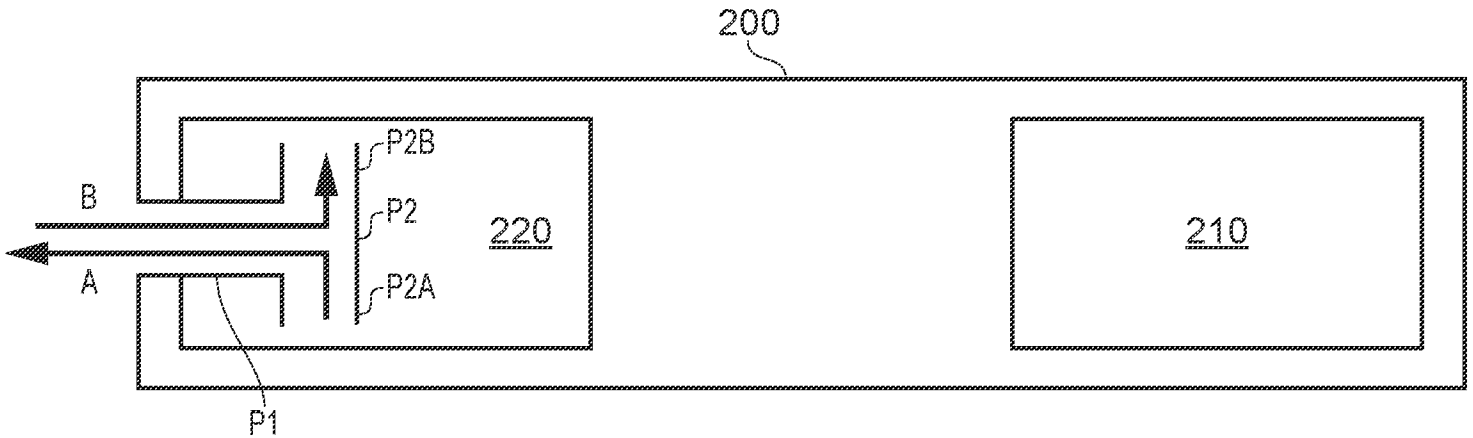
FIG. 2 schematically shows a longitudinal cross-sectional view of an example of a non-combustible aerosol delivery system.

In the example shown in FIG. 2, a system 200 is shown with a power source 210 and a filter unit 220. The inhalate airflow path A and exhalate airflow path B are shown. Both enter a pathway P1 which then branches at P2. Inhalate airflow path A enters pathway P1 from branch P2A. Exhalate airflow path B exits pathway P1 into branch P2B. In this way, the two airflow paths A,B share portion P1 of the pathway P1, P2.

Though not shown, P1 may connect pathway P2 to an outlet or a mouthpiece of the system 200. P2 may branch along inhalate path P2A to a heater and aerosolizable material arrangement wherein a vapor is produced for inhalation. P2 may branch along exhalate path P2B to a filter, a separator, a vortex separator, a complex flow path separator or a water filtration unit or the like, or a combination of such elements for removing vapor from the exhalate breath of a user.

Figure 3:
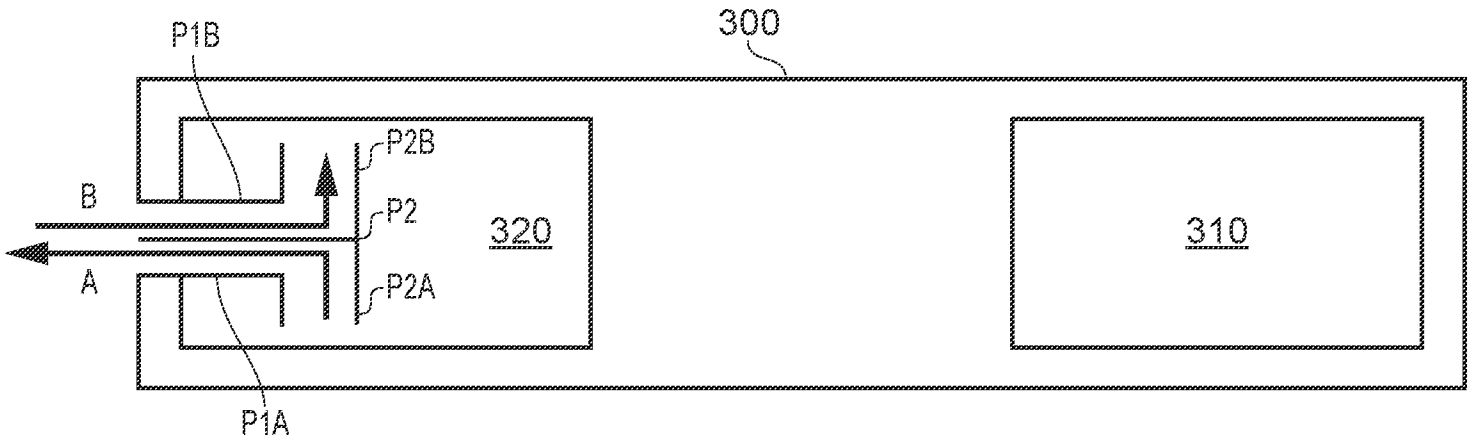
FIG. 3 schematically shows a longitudinal cross-sectional view of an example of a non-combustible aerosol delivery system.

In the example shown in FIG. 3, a system 300 is shown with a power source 310 and a filter unit 320. The arrangement is similar to the arrangement of the system 200 shown in FIG. 2. In FIG. 3, the portion P1 of the pathway P1, P2 is broken into two portions P1A, P1B. The additional element running between the pathways P1A, P1B ensures the inhalation airflow path A and exhalate airflow path B are entirely distinct from each other. This ensures that breath from the user cannot condense onto a surface of a pathway through which vapor to be inhaled will travel. This therefore improves the lifetime of the overall system 300 and also improves user experience of the system 300.

As described earlier for FIG. 2, the pathways P2A, P2B may continue to join to an aerosolizable material and heater combination (P2A) or any of the filter unit elements as described earlier, separator etc., for pathway P2B.

The pathway P2B may be extended to increase the opportunity for the exhalate vapor to condense prior to collection by the filter unit 320. The longer the pathway P2B, the greater surface area the exhalate has to condense as well as the separate advantage of the exhalate having a greater time to cool in the system as the exhalate is likely to be hotter than the internal of the system 300. As condensation is more likely to occur at cooler temperatures, this in turn renders the system 300 more effective at inducing condensation in the exhalate.

In an example, the system as described herein comprises a unit containing a vapor forming material or the like. Such a vapor forming material may include a liquid or a solid. The vapor forming material may contain nicotine or the like. The material may comprise one or more active constituents, one or more flavors, one or more aerosol-former materials, and/or one or more other functional materials.

The unit containing the vapor forming material may be arranged within the system disclosed herein as separate to the power source and the filter. In an example, the power source may be arranged at a distal end of the system. The unit containing the vapor forming material may be proximal to and connected to the power source, as the unit may use power so as to form vapor from the vapor forming material, such as use of electrical power to generate a vapor from heating a vapor forming material. The filter unit may be at a proximal end of the system such that the vapor from the unit containing the vapor forming material may pass the vapor to the mouthpiece or outlet near the user for inhalation prior to the user exhaling back into the system. This arrangement may be specifically advantageous for arrangements of airflow and electrical connections.

In an example, the filter unit and the unit containing the vapor forming material together form a single assembly which is removable from the non-combustible aerosol delivery system. In such an arrangement, the manufacturer may be able to control the amount of vapor forming material provided per filter unit and filter in the filter unit such that the amount of vapor forming material would be sufficient to provide an amount of vapor that would, under most usage patterns, be sufficient to saturate or otherwise use up the filter. In such a way, the lifetime of the vapor forming material and the filter may be matched or balanced so that, when the vapor forming material is used up, so too is the filter, the single assembly can be removed and replaced with a new single assembly. This improves the ease of use of the device and therefore improves the user's experience of the system.

Relatedly, this may also enable easy removable of one portion of the system which may need more regular cleaning than e.g. the section of the system containing the power source. As airflow need not pass through the power source, there is less likelihood of regular cleaning being needed at the power source. By enabling cleaning of a portion which requires cleaning more regularly, the overall lifetime of the system may be increased.

Furthermore, replacement filters or the like may be inserted into the single assembly as the filter unit ages with use. Again, this will increase the overall lifetime of the system and prevent the full system being thrown away after a filter unit is depleted. The vapor forming material may also be removed from the single assembly and replaced to increase the lifetime of the system.

Alternatively, the single assembly may be used and discarded, after use, for replacement with another single assembly. This arrangement would prevent a user needing to contact vapor forming material which can be unpleasant and difficult to handle. In this way, the user's experience of the system is improved. Furthermore, discarding only the single assembly ensures the power source portion of the system is not wastefully thrown away. The power source may, in any example herein, be rechargeable and therefore not in need of being discarded but rather recharged.

The non-combustible aerosol delivery device may have a generally cylindrical shape, extending along a longitudinal axis, and may comprise two main components, optionally a control body (containing the power source) and a cartomizer (containing the filter unit). The cartomizer may include an internal chamber containing a reservoir of a payload such as for example a liquid comprising nicotine, a vaporizer (such as a heater), and a mouthpiece. References to 'nicotine' herein will be understood to be merely exemplary and can be substituted with any suitable active ingredient. References to 'liquid' as a payload herein will be understood to be merely exemplary and can be substituted with any suitable payload such as botanical matter (for example tobacco that is to be heated rather than burned), or a gel comprising an active ingredient and/or flavoring. The reservoir may comprise a foam matrix or any other structure for retaining the liquid until such time that it is required to be delivered to the vaporizer. In the case of a liquid/flowing payload, the aerosol generating component is for vaporizing the liquid, and the cartomizer may further include a wick or similar facility to transport a small amount of liquid from the reservoir to a vaporizing location on or adjacent the aerosol generating component. In the present disclosure, a heater is used as a specific example of an aerosol generating component. However, it will be appreciated that other forms of aerosol generating component (for example, those which utilize ultrasonic waves) could also be used and it will also be appreciated that the type of aerosol generating component used may also depend on the type of payload to be vaporized.

The power source may include a re-chargeable cell or battery to provide power to the non-combustible aerosol delivery system. The power source may also include a circuit board for generally controlling the non-combustible aerosol delivery system. In an example, when the aerosol generating component receives power from the battery, which may be controlled by the circuit board, the aerosol generating component vaporizes the liquid and this vapor is then inhaled by a user through a mouthpiece. In some specific embodiments the body is further provided with a manual activation device, e.g. a button, switch, or touch sensor located on the outside of the body.

The control body and cartomizer may be detachable from one another, but are joined together when the system is in use by a connection to provide mechanical and electrical connectivity between the control body and the cartomizer. The electrical connector on the control body 20 that is used to connect to the cartomizer may also serve as a socket for connecting a charging device (not shown) when the control body is detached from the cartomizer. The other end of the charging device may be plugged into a USB socket to re-charge the cell in the control body of the non-combustible aerosol delivery device which may be an e-cigarette. In other implementations, a cable may be provided for direct connection between the electrical connector on the control body and a USB socket.

The non-combustible aerosol delivery device is provided with one or more holes for air inlets. These holes connect to an air passage through the electronic aerosol provision device to the mouthpiece. When a user inhales through the mouthpiece, air is drawn into this air passage through the one or more air inlet holes, which are suitably located on the outside of the non-combustible aerosol delivery device. When the heater is activated to vaporize the nicotine from the cartridge, the airflow passes through, and combines with, the generated vapor, and this combination of airflow and generated vapor then passes out of the mouthpiece to be inhaled by a user. Except in single-use devices, the cartomizer may be detached from the control body and disposed of when the supply of liquid is exhausted (and replaced with another cartomizer if so desired).

In some cases, the non-combustible aerosol delivery device may comprise means to control aspects of the airflow in the system. A portion of the airflow pathway providing a fluid communication path between the mouthpiece and one or more air inlet holes in the device to may be provided with features which are movable to change the shape of the airflow pathway (e.g. the topology of the walls bounding the air flow path), and thereby change characteristics of airflow in the non-combustible aerosol delivery device. For instance, movable features (such as valves, baffles or inlets) may enable modification of operating parameters such as the resistance to draw of the system, the degree of turbulence in the airflow pathway, the direction of airflow in the vicinity of aerosol generating component, and the condensation path distance between the aerosol generating component and the mouthpiece.

In some examples, the resistance to draw of the device can be modified by providing means to selectively open or close one or more air inlets configured to allow air into the air passage comprised in the device. In some examples, elements may be provided to change the direction of airflow into or out of the system. In this way, the flow paths of inhalate airflow path A and exhalate airflow path B may be controlled. For example, a slider may be provided on the outer housing of the system, configured to be moved to different positions (e.g. rotated about an axis or displaced along an axis). The slider may be mechanically or electrically connected so as to cause a resulting change in the pathways A, B such as via movement of a baffle or valve or the like.

In some examples, the slider may be actuated by an electromechanical actuator such as a linear or rotational actuator, and the actuator position controlled by the control circuitry to adjust the position of components controlling the form of airflow paths A,B. Other features may be included in the device to modify the airflow through the device, controlled by the control circuitry in a similar manner. For example, one or more moveable baffles, or a mechanical aperture, or one or more air inlets may be disposed in an air passage of the system near the aerosol generating component or, e.g., the mouthpiece. These features may be moved into different positions to adjust the manner in which incident airflow exits the aerosol generating component or enters/exits the mouthpiece of the system.

For example, one or more baffles may be moved to direct airflow into portion P1 of the pathway through the system 200 (during inhalation) and into portion P2B of the pathway through the system 200 (during exhalation).

It will be appreciated that the non-combustible aerosol delivery devices shown in FIGS. 1 to 3 are presented by way of example, and various other implementations can be adopted. For example, in some embodiments, the cartomizer may be provided as two separable components, namely a cartridge comprising the liquid reservoir and mouthpiece (which can be replaced when the liquid from the reservoir is exhausted), and an aerosol generating component comprising a heater (which is generally retained). As another example, the charging facility may connect to an additional or alternative power source, such as a car cigarette lighter.

As used herein, non-combustible aerosol provision systems, or non-combustible aerosol delivery systems, are systems that release compounds from an aerosol-generating material without combusting the aerosol-generating material, such as electronic cigarettes, tobacco heating products, and hybrid systems to generate aerosol using a combination of aerosol-generating materials.

According to the present disclosure, a "non-combustible" aerosol provision system is one where a constituent aerosol-generating material of the aerosol provision system (or component thereof) is not combusted or burned in order to facilitate delivery of at least one substance to a user.

In some embodiments, the delivery system is a non-combustible aerosol provision system, such as a powered non-combustible aerosol provision system.

In some embodiments, the non-combustible aerosol provision system is an electronic cigarette, also known as a vaping device or electronic nicotine delivery system (END), although it is noted that the presence of nicotine in the aerosol-generating material is not a requirement.

In some embodiments, the non-combustible aerosol provision system is an aerosol-generating material heating system, also known as a heat-not-burn system. An example of such a system is a tobacco heating system.

In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid or gel and may or may not contain nicotine. In some embodiments, the hybrid system comprises a liquid or gel aerosol-generating material and a solid aerosol-generating material. The solid aerosol-generating material may comprise, for example, tobacco or a non-tobacco product.

Typically, the non-combustible aerosol provision system may comprise a non-combustible aerosol provision device and a consumable for use with the non-combustible aerosol provision device.

In some embodiments, the disclosure relates to consumables comprising aerosol-generating material and configured to be used with non-combustible aerosol provision devices. These consumables are sometimes referred to as articles throughout the disclosure.

In some embodiments, the non-combustible aerosol provision system, such as a non-combustible aerosol provision device thereof, may comprise a power source and a controller. The power source may, for example, be an electric power source or an exothermic power source. In some embodiments, the exothermic power source comprises a carbon substrate which may be energized so as to distribute power in the form of heat to an aerosol-generating material or to a heat transfer material in proximity to the exothermic power source.

In some embodiments, the non-combustible aerosol provision system may comprise an area for receiving the consumable, an aerosol generator, an aerosol generation area, a housing, a mouthpiece, a filter and/or an aerosol-modifying agent.

In some embodiments, the consumable for use with the non-combustible aerosol provision device may comprise aerosol-generating material, an aerosol-generating material storage area, an aerosol-generating material transfer component, an aerosol generator, an aerosol generation area, a housing, a wrapper, a filter, a mouthpiece, and/or an aerosol-modifying agent.

In the above, there is a disclosure of a system for capturing exhalate using a filter unit. The filter unit comprises a filter and the filter may be selected so as to most effectively capture exhalate. Effective capturing of exhalate by the filter means that the filter unit need not contain large filters and therefore enables more compact conformations of the system. In such a way, the system may be more freely designed and therefore designs tailored to ergonomic designs may be selected. In this way, the user's experience of the system can be improved.

We now present results from specific filter materials. The filter may advantageously be formed from glass fiber, which includes glass microfiber, and/or polypropylene.

The filters may be provided in any shape corresponding to the shape of the system or airway in which the filter is located. In this sense, the filter may be any shape. In a specific example, the filter may be round with size defined by a diameter and thickness. In specific examples, the filter may be from around 25 mm to around 50 mm in diameter with a thickness of around 0.02 mm to around 0.8 mm.

The filters may have differing pore sizes selected so as to balance the filtering provided to the exhalate against the pressure difference experienced by the user on exhalation. In specific examples, the pore size may be from around 0.2 μm to around 30 μm.

The filters may have differing masses according to the diameters, thicknesses and materials. In specific examples, the filter may have a mass of from around 0.01 g to around 0.35 g.

In specific examples, the filter may be formed entirely or partially from:

Glass microfiber filter with a diameter of 25 mm, a pore size of 1.2 μm, a mass per 25 mm circle of 0.025 g with a thickness of 0.238 mm. Such a filter is available from Whatman.

Glass microfiber filter with a diameter of 25 mm, a pore size of 1.0 μm, a mass per 25 mm circle of 0.065 g with a thickness of 0.553 mm. Such a filter is available from Whatman.

Glass microfiber filter with a diameter of 25 mm, a pore size of 0.7 μm, a mass per 25 mm circle of 0.039 g with a thickness of 0.376 mm. Such a filter is available from Whatman.

Polypropylene filter from a large air-con unit with a diameter of 25 mm cut from a larger portion of filter, a pore grade of F8, a mass per 25 mm circle of 0.060 g with a thickness of 0.804 mm. Such a filter is available from RS Pro.

Glass microfiber filter with a diameter of 47 mm, a pore size of 0.3 μm, a mass per 25 mm circle of 0.047 g with a thickness of 0.308 mm. Such a filter is available from Whatman.

Glass microfiber filter with a diameter of 25 mm, a pore size of 1.6 μm, a mass per 25 mm circle of 0.025 g with a thickness of 0.250 mm. Such a filter is available from Whatman.

Polypropylene filter from a large air-con unit with a diameter of 25 mm cut from a larger portion of filter, a pore grade of F6/M5, a mass per 25 mm circle of 0.049 g with a thickness of 0.587 mm. Such a filter is available from RS Pro.

Glass microfiber filter with a diameter of 25 mm, a pore size of 2.7 μm, a mass per 25 mm circle of 0.062 g with a thickness of 0.541 mm. Such a filter is available from Whatman.

Glass fiber membrane filter with a diameter of 25 mm, a pore size of 29 μm, a mass per 25 mm circle of 0.305 g with a thickness of 0.036 mm. Such a filter is available from Saint-Gobain.

Glass fiber membrane filter with a diameter of 25 mm, a pore size of 30 μm, a mass per 25 mm circle of 0.347 g with a thickness of 0.034 mm. Such a filter is available from Saint-Gobain.

Glass fiber cuts filter with a size of 60×90 mm, a pore size of 3 μm, a mass per 25 mm circle of 0.259 g with a thickness of 0.035 mm. Such a filter is available from Whatman.

As mentioned above, the pressure drop across the chosen filter is a relevant consideration when trying to balance the filtering, provided by the filter in the filter unit, and the user experience during exhalation. If the pressure during exhalation is too great, the user may preferentially not exhale into the system which is to be avoided. The below are test results produced investigating pressure for filter materials when fresh.

Example 1 (Prior Art)

In a commercial system available from Philter Labs, testing over a series of flow rates from 14.18 mL/s to 1635 mL/s and a series of pressures from 59.26 Pa to 21910 Pa was performed. It was found that, for a flow rate of 18.3 mL/s a pressure drop of 67.98 Pa was found while for a flow rate of 390 mL/s a pressure drop of 1946 Pa was found.

Example 2

A filter was provided from glass microfiber filter with a diameter of 25 mm, a pore size of 1.2 μm, a mass per 25 mm circle of 0.025 g with a thickness of 0.238 mm.

The pressure drop was tested over a series of flow rates from 12.15 mL/s to 1218 mL/s and a series of pressures from 161.2 Pa to 21120 Pa and subsequently retested over a series of flow rates from 6.862 mL/s to 1058 mL/s and a series of pressures from 254.6 Pa to 33180 Pa. Therefore, for a flow rate of 18.3 mL/s a pressure drop of 572 Pa was found while for a flow rate of 82.5 mL/s a pressure drop of 2382 Pa was found. This filter provided high efficacy of capturing exhalate however this filter provided a somewhat high pressure drop.

Example 3

A filter was provided from glass microfiber filter with a diameter of 25 mm, a pore size of 1.0 μm, a mass per 25 mm circle of 0.065 g with a thickness of 0.553 mm.

The pressure drop was tested over a series of flow rates from 13.4 mL/s to 1229 mL/s and a series of pressures from 139.1 Pa to 35130 Pa and subsequently retested over a series of flow rates from 8.221 mL/s to 802.5 mL/s and a series of pressures from 405.5 Pa to 33680 Pa. Therefore, for a flow rate of 18.3 mL/s a pressure drop of 804.5 Pa was found while for a flow rate of 82.5 mL/s a pressure drop of 3316 Pa was found. This filter provided high efficacy of capturing exhalate however this filter provided a fairly high pressure drop.

Example 4

A filter was provided from glass microfiber filter with a diameter of 25 mm, a pore size of 0.7 μm, a mass per 25 mm circle of 0.039 g with a thickness of 0.376 mm.

The pressure drop was tested over a series of flow rates from 4.743 mL/s to 538 mL/s and a series of pressures from 419.3 Pa to 33880 Pa. Therefore, for a flow rate of 18.3 mL/s a pressure drop of 1233 Pa was found while for a flow rate of 82.5 mL/s a pressure drop of 5242 Pa was found. This filter provided high efficacy of capturing exhalate however this filter provided a high pressure drop.

Example 5

A filter was provided from polypropylene filter from a large air-con unit with a diameter of 25 mm cut from a larger portion of filter, a pore grade of F8, a mass per 25 mm circle of 0.060 g with a thickness of 0.804 mm.

The pressure drop was tested over a series of flow rates from 12.7 mL/s to 1638 mL/s and a series of pressures from 28.76 Pa to 19780 Pa. Therefore, for a flow rate of 18.3 mL/s a pressure drop of 39.0 Pa was found while for a flow rate of 82.5 mL/s a pressure drop of 169.8 Pa was found. This filter provided high efficacy of capturing exhalate however this filter provided a low pressure drop.

Example 6

A filter was provided from glass microfiber filter with a diameter of 47 mm, a pore size of 0.3 μm, a mass per 25 mm circle of 0.047 g with a thickness of 0.308 mm.

The pressure drop was tested over a series of flow rates from 13.14 mL/s to 1476 mL/s and a series of pressures from 261.5 Pa to 35050 Pa and subsequently retested over a series of flow rates from 6.163 mL/s to 1227 mL/s and a series of pressures from 215 Pa to 34450 Pa. Therefore, for a flow rate of 18.3 mL/s a pressure drop of 503.4 Pa was found while for a flow rate of 82.5 mL/s a pressure drop of 2009 Pa was found. This filter provided high efficacy of capturing exhalate and this filter provided a somewhat reasonable pressure drop.

Example 7

A filter was provided from glass microfiber filter with a diameter of 25 mm, a pore size of 1.6 μm, a mass per 25 mm circle of 0.025 g with a thickness of 0.250 mm.

The pressure drop was tested over a series of flow rates from 5.494 mL/s to 1463 mL/s and a series of pressures from 186.8 Pa to 34140 Pa. Therefore, for a flow rate of 18.3 mL/s a pressure drop of 385.4 Pa was found while for a flow rate of 82.5 mL/s a pressure drop of 1437 Pa was found. This filter provided high efficacy of capturing exhalate and this filter provided a fairly reasonable pressure drop.

Example 8

A filter was provided from polypropylene filter from a large air-con unit with a diameter of 25 mm cut from a larger portion of filter, a pore grade of F6/M5, a mass per 25 mm circle of 0.049 g with a thickness of 0.587 mm.

The pressure drop was tested over a series of flow rates from 11.38 mL/s to 1666 mL/s and a series of pressures from 53.86 Pa to 18850 Pa. Therefore, for a flow rate of 18.3 mL/s a pressure drop of 61.25 Pa was found while for a flow rate of 82.5 mL/s a pressure drop of 140.2 Pa was found. This filter provided high efficacy of capturing exhalate however this filter provided a low pressure drop.

Example 9

A filter was provided from glass microfiber filter with a diameter of 25 mm, a pore size of 2.7 μm, a mass per 25 mm circle of 0.062 g with a thickness of 0.541 mm.

The pressure drop was tested over a series of flow rates from 9.979 mL/s to 1621 mL/s and a series of pressures from 162.6 Pa to 30690 Pa. Therefore, for a flow rate of 18.3 mL/s a pressure drop of 246.2 Pa was found while for a flow rate of 82.5 mL/s a pressure drop of 924.9 Pa was found. This filter provided high efficacy of capturing exhalate and this filter provided a reasonable pressure drop.

Example 10

A filter was provided from glass fiber cuts filter with a size of 60×90 mm, a pore size of 3 μm, a mass per 25 mm circle of 0.259 g with a thickness of 0.035 mm.

The pressure drop was tested over a series of flow rates from 8.474 mL/s to 1313 mL/s and a series of pressures from 196.4 Pa to 25860 Pa. Therefore, for a flow rate of 18.3 mL/s a pressure drop of 334.8 Pa was found while for a flow rate of 82.5 mL/s a pressure drop of 1257 Pa was found.

Performance During Use

Figure 4:
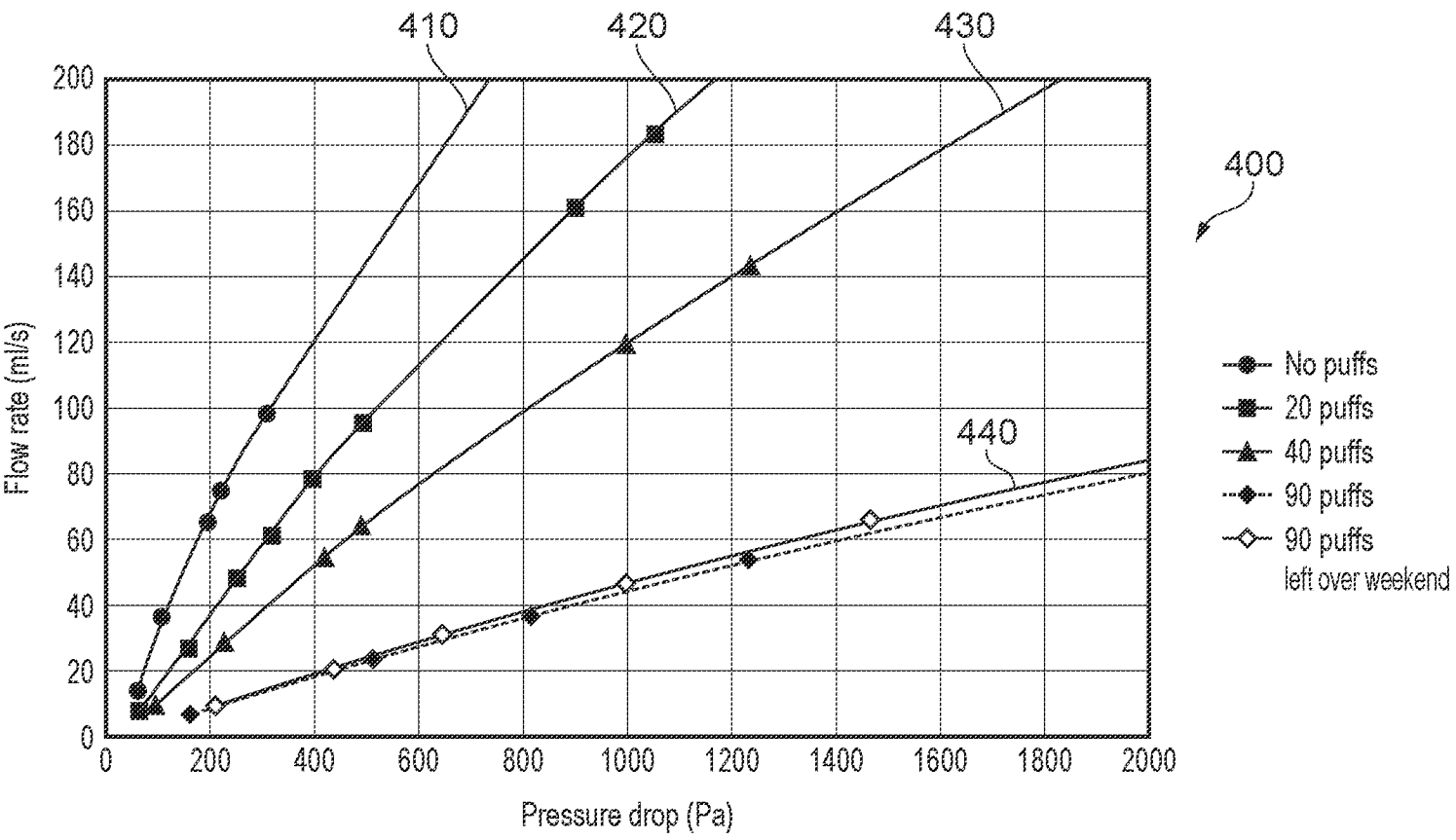
FIG. 4 schematically shows a graph of pressure in Pascal against flow rate in mL/s for a currently available filter over its lifetime.

Selection of the filter materials should take into account the pressure drop across the filter as shown about. Furthermore, selection of the filter materials should take into account pressure drops across the lifetime of the filter. Indeed, it is not useful for the filter to be effective and with an advantageous pressure drop across only the first portion of the lifetime of the filter. Therefore, experiments were conducted to assess the performance of filters over a number of puffs. The results are shown in FIG. 4 onwards. These are discussed in accordance with the following specific examples. Notably a smoking lifetime of a filter may be any number of puffs but more standardly may be up to 40, 50, 60 or 70 puffs. More puffs is therefore unlikely for a filter and the performance of a filter should be tailored to this lifetime.

Example 11 (Prior Art)

Shown in FIG. 4 is a graph 400 of pressure in Pascal on the X axis against flow rate in mL/s for a filter in the commercial system available from Philter Labs (of Example 1). The line 410 represents a filter of a 0 puff lifetime, i.e. a fresh filter. The lines 420, 430, 440 represent the performance of the same filter over a lifetime of 20, 40 and 90 puffs respectively. The filter can be seen to degrade in performance significantly over its lifetime. The 90-puff line 440 in particular shows that the pressure increase required to obtain a flow rate increase is such that the filter has a poor performance in later life.

Example 12

Figure 5:
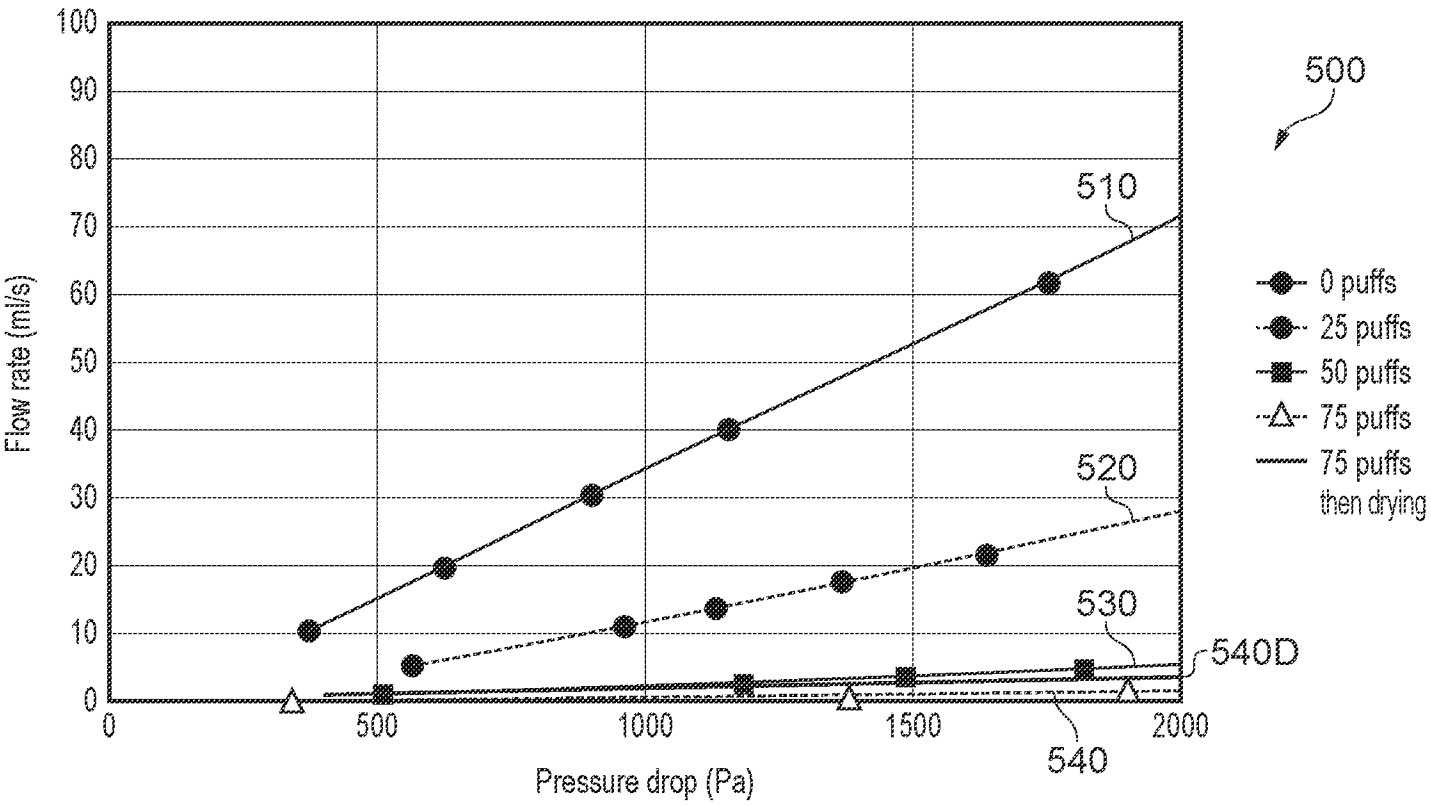
FIG. 5 schematically shows a graph of pressure in Pascal against flow rate in mL/s for an example filter over its lifetime.

Shown in FIG. 5 is a graph 500 of pressure in Pascal on the X axis against flow rate in mL/s for a filter formed from glass microfiber filter with a diameter of 47 mm, a pore size of 0.3 μm, a mass per 25 mm circle of 0.047 g with a thickness of 0.308 mm.

The line 510 represents a filter of a 0 puff lifetime, i.e. a fresh filter. The lines 520, 530, 540 represent the performance of the same filter over a lifetime of 25, 50 and 75 puffs respectively. The filter can be seen to change in performance significantly, over its lifetime. The line 540D shows the performance of the filter of 75 puffs which was subsequently dried. This line indicates an improvement in filter performance can be obtain by drying.

The improvement in performance following drying can be explained as during use the filter has puffs which travel through it and condensate build on the filter. Due to the small pore size of this filter, the condensate will block the pores of the filter up. The condensate is a mixture of glycerol, propylene glycol and water, and therefore drying will remove at least water and potentially both glycerol and propylene glycol.

The drying occurred after 75 puffs and the drying took place over around a 3 day period. The sample of FIG. 5 can be seen to have a worse performance than the sample of FIG. 4.

Example 13

Figure 6:
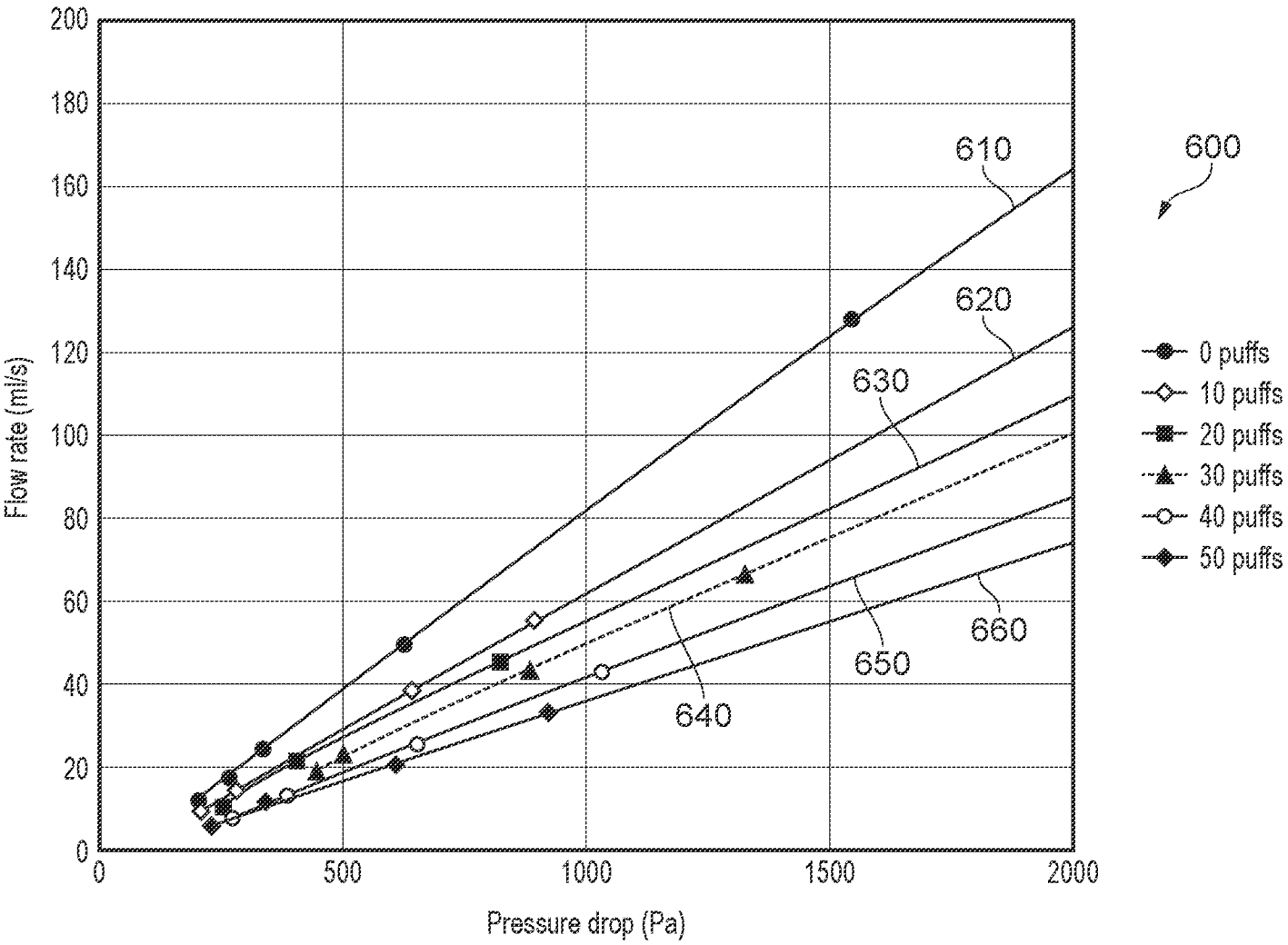
FIG. 6 schematically shows a graph of pressure in Pascal against flow rate in mL/s for an example filter over its lifetime; and, FIG. 7 schematically shows a graph of pressure in Pascal against flow rate in mL/s for an example filter over its lifetime.
Figure 7:
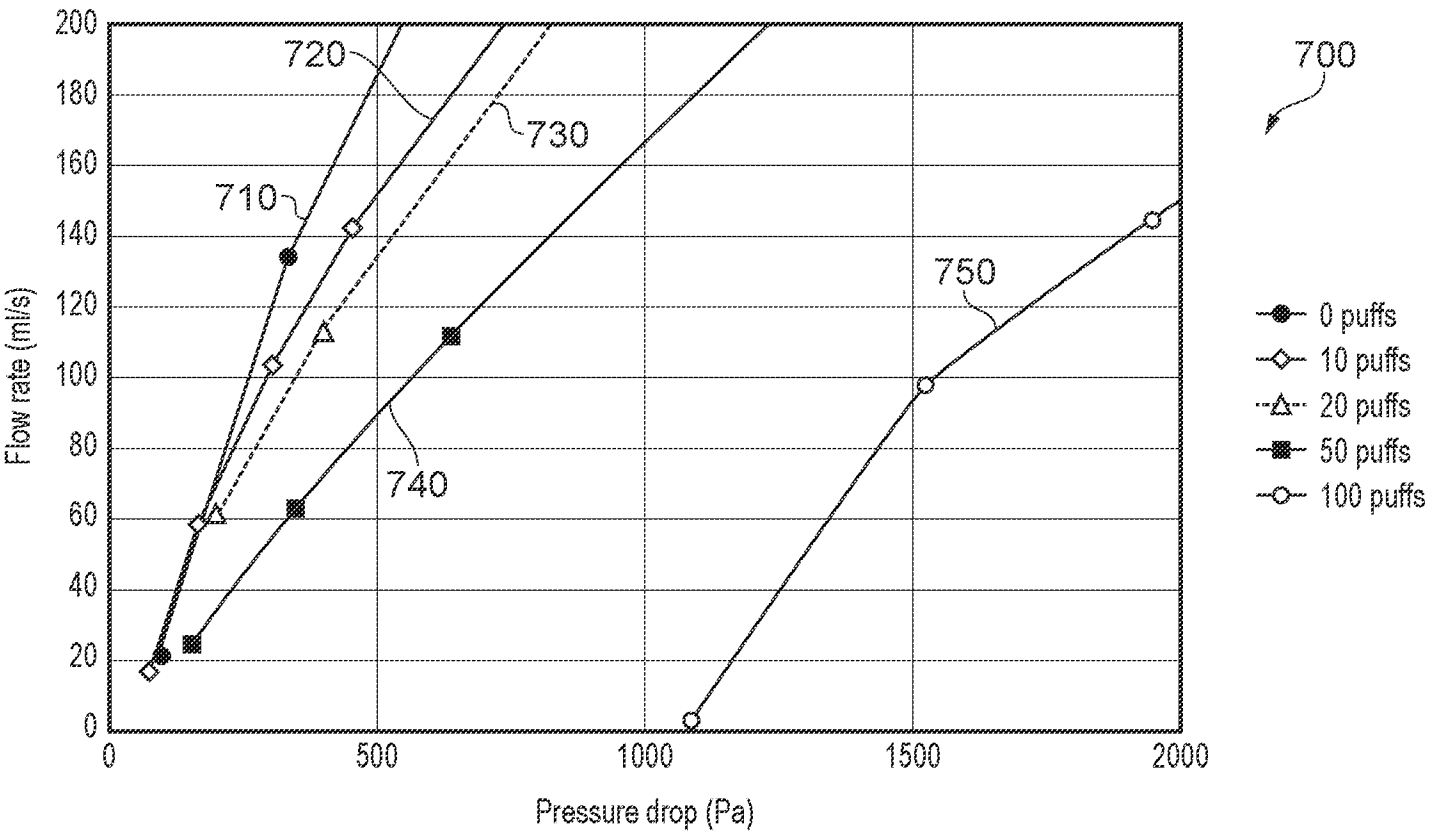

Shown in FIG. 6 is a graph 600 of pressure in Pascal on the X axis against flow rate in mL/s for a filter formed from glass microfiber filter with a diameter of 25 mm, a pore size of 2.7 μm, a mass per 25 mm circle of 0.062 g with a thickness of 0.541 mm.

The line 610 represents a filter of a 0 puff lifetime, i.e. a fresh filter. The lines 620, 630, 640, 650, 660 represent the performance of the same filter over a lifetime of 10, 20, 30, 40 and 50 puffs respectively. Notably, the filter can be seen not to degrade in performance significantly over its lifetime. Though the lines do indicate some degradation in performance, this filter has a significantly improved performance overall lifetime performance than the filters shown in FIGS. 4 and 5. This shows an improvement in performance particularly in terms of consistency of performance.

Example 14

Shown in FIG. 6 is a graph 600 of pressure in Pascal on the X axis against flow rate in mL/s for a filter formed from polypropylene filter from a large air-con unit with a diameter of 25 mm cut from a larger portion of filter, a pore grade of F8, a mass per 25 mm circle of 0.060 g with a thickness of 0.804 mm.

The line 710 represents a filter of a 0 puff lifetime, i.e. a fresh filter. The lines 720, 730, 740 and 750 represent the performance of the same filter over a lifetime of 10, 20, 50 and 100 puffs respectively. Notably, the filter can be seen not to degrade in performance significantly over its lifetime. Though the lines do indicate some degradation in performance, this filter has a significantly improved performance overall lifetime performance than the filters shown in FIGS. 4 and 5. This shows an improvement in performance particularly in terms of pressure drop.

Indeed, the decrease in performance of the filter between 100 puffs (performance shown by line 750) and 200 puffs (performance shown by line 770) is quite insignificant. As such, this filter performs particularly well over the currently available system shown in FIG. 4.

The foregoing discussion discloses and describes merely exemplary embodiments of the present disclosure. As will be understood by those skilled in the art, the present disclosure may be embodied in other specific forms without departing from the essential characteristics thereof. Accordingly, the content of the present disclosure is intended to be illustrative, but not limiting of the scope of the disclosure, as well as of the claims. The disclosure, including any readily discernible variants of the teachings herein, defines, in part, the scope of the foregoing claim terminology.

The invention claimed is:

1. A non-combustible aerosol delivery system for filtering exhaled breath, the aerosol delivery system comprising:

a power source;

a filter unit;

a unit containing a vapor forming material;

an inhalate airflow path adapted to convey vapor generated by the aerosol delivery system to a user during an inhalation, and an exhalate airflow path adapted to convey breath from the user to the filter unit during an exhalation into the aerosol delivery system, wherein at least a portion of the inhalate airflow path and a portion of the exhalate airflow path are the same;

wherein the filter unit contains at least one filter, and wherein the at least one filter comprises glass fiber, polypropylene, or a combination of glass fiber and polypropylene;

wherein the filter unit and the unit containing the vapor forming material together form a single assembly which is removable from the non-combustible aerosol delivery system.

2. The non-combustible aerosol delivery system of claim 1, wherein the at least one filter comprises glass fiber.

3. The non-combustible aerosol delivery system of claim 2, wherein the at least one filter comprises at least a first filter comprising glass fiber, and a second filter which is a HEPA filter.

4. The non-combustible aerosol delivery system of claim 1, wherein the at least one filter comprises polypropylene.

5. The non-combustible aerosol delivery system of claim 1, wherein the filter unit further comprises a separator for separating aerosol droplets from vapor.

6. The non-combustible aerosol delivery system of claim 1, wherein the filter unit further comprises a vortex separator.

7. The non-combustible aerosol delivery system of claim 1, wherein the filter unit further comprises a complex flow path separator configured to elongate a path along which an exhalate flow travels.

8. The non-combustible aerosol delivery system of claim 1, wherein the filter unit further comprises a water filtration unit, the water filtration unit comprising water through which exhalate may be passed to filter the exhalate.

9. The non-combustible aerosol delivery system of claim 1, wherein the filter unit comprises at least one deodorizing filter.

10. The non-combustible aerosol delivery system of claim 1, wherein the at least one filter comprises activated carbon.

11. The non-combustible aerosol delivery system of claim 1, wherein the non-combustible aerosol delivery system is an electronic cigarette.

12. The non-combustible aerosol delivery system of claim 1, wherein the non-combustible aerosol delivery system is an aerosol generating material heating system.

13. The non-combustible aerosol delivery system of claim 1, wherein the non-combustible aerosol delivery system generates aerosol using a combination of aerosol-generating materials, and wherein one or a plurality of the aerosol-generating materials may be heated.

* * * * *